US008047220B2

(12) United States Patent
Grözinger et al.

(10) Patent No.: US 8,047,220 B2
(45) Date of Patent: Nov. 1, 2011

(54) GAS CABINET

(75) Inventors: Stefan Grözinger, Stuttgart (DE); Denis Simonovic, Stuttgart (DE); Martin Beigl, Bisingen (DE)

(73) Assignee: MWZ Beteiligungs GmbH, Stuttgart (DE)

( * ) Notice: Subject to any disclaimer, the term of this patent is extended or adjusted under 35 U.S.C. 154(b) by 864 days.

(21) Appl. No.: 11/687,070

(22) Filed: Mar. 16, 2007

(65) Prior Publication Data

US 2008/0012458 A1 Jan. 17, 2008

(30) Foreign Application Priority Data

Mar. 17, 2006 (DE) ..... 10 2006 013 942

(51) Int. Cl.
*A47B 96/00* (2006.01)

(52) U.S. Cl. ..... 137/240

(58) Field of Classification Search ..... 137/240, 137/115.04, 15.05, 312, 15.04
See application file for complete search history.

(56) References Cited

U.S. PATENT DOCUMENTS

| | | | | |
|---|---|---|---|---|
| 3,394,645 A | | 7/1968 | Acker | |
| 4,603,707 A | | 8/1986 | Gregoire | |
| 4,625,627 A | | 12/1986 | Livanos | |
| 5,151,395 A | | 9/1992 | Tom | |
| 5,320,817 A | * | 6/1994 | Hardwick et al. | 423/237 |
| 5,707,424 A | * | 1/1998 | Tom et al. | 95/95 |
| 6,648,021 B2 | * | 11/2003 | Zheng et al. | 137/240 |
| 6,880,592 B2 | | 4/2005 | Gregg | |

FOREIGN PATENT DOCUMENTS

| | | |
|---|---|---|
| DE | 30 21 747 A1 | 12/1981 |
| DE | 195 08 046 C2 | 9/1996 |
| EP | 0 569 020 A1 | 11/1993 |
| EP | 1 037 269 A1 | 9/2000 |
| WO | 03/081124 A1 | 10/2003 |

* cited by examiner

*Primary Examiner* — Kevin L Lee

(74) *Attorney, Agent, or Firm* — Gudrun E. Huckett

(57) ABSTRACT

A gas cabinet has a housing receiving at least one gas bottle. The housing has at least one intake opening and at least one exit opening. A conduit system is located in the housing to which the at least one gas bottle is to be connected. A scavenging air passage for a scavenging air flow entering the housing through the at least one intake opening and exiting from the housing through the at least one exit opening is provided. The gas cabinet is configured such that an open flow cross-section of the air passage for the scavenging air in the housing is limited to an amount necessary for a reliable scavenging action. At least one displacement body is arranged in the housing for limiting the flow cross-section in the housing.

24 Claims, 3 Drawing Sheets

GAS CABINET

BACKGROUND OF THE INVENTION

The invention relates to a gas cabinet with a housing in which at least one gas bottle is arranged that is connected to a conduit system that is located in the housing and is positioned within a scavenging air flow that enters through at least one intake opening the housing and exits from the housing through at least one exit opening.

In particular in the semiconductor industry gas cabinets are used in which gas bottles containing gases are present which gases are supplied by means of a conduit system to consumers. The gases can be poisonous, corrosive or combustible. For this reason, it is necessary that scavenging air flows through the gas cabinet in order to remove gases that have leaked without the gases reaching the environment in an uncontrolled fashion. Since it is required to provide a minimum air flow rate in the open cross-section of the gas cabinet for a safe removal of gases escaping through leaks at the connectors and pipe conduits above the gas bottle, large amounts of air are required in known configurations of gas cabinets; this leads to significant operating costs.

It is an object of the invention to configure a gas cabinet of the aforementioned kind such that the installation and operating costs are reduced.

SUMMARY OF THE INVENTION

This object is solved for a gas cabinet of the aforementioned kind in accordance with the present invention in that the gas cabinet is designed such that the open flow cross-section of the scavenging air passage for the scavenging air in the housing is limited to the amount necessary for a reliable scavenging action.

In the gas cabinet according to the present invention the required volume flow of the scavenging air is reduced by reducing the cross-section. In this way, the flow cross-section for the scavenging air can be minimized such that a reliable scavenging action is just about still possible. In this way, the scavenging air quantity to be removed is reduced to a minimum without this having disadvantageous effects on the safety of the gas cabinet according to the invention.

Advantageously, for limiting the flow cross-section at least one displacement body is used which is arranged within the housing. The displacement body is gas-tight or air-tight so that the gases cannot penetrate into the displacement body but are reliably removed by the scavenging air.

Instead of the displacement body, a reduced housing volume can also be provided. The housing in this case can be provided with reduced width and/or depth in the appropriate areas.

Further features of the invention result from the further claims, the description, and the drawings.

BRIEF DESCRIPTION OF THE DRAWINGS

The invention will be explained in more detail with the aid of embodiments illustrated in the drawings. It is shown in.

DESCRIPTION OF PREFERRED EMBODIMENTS

Figure 2:
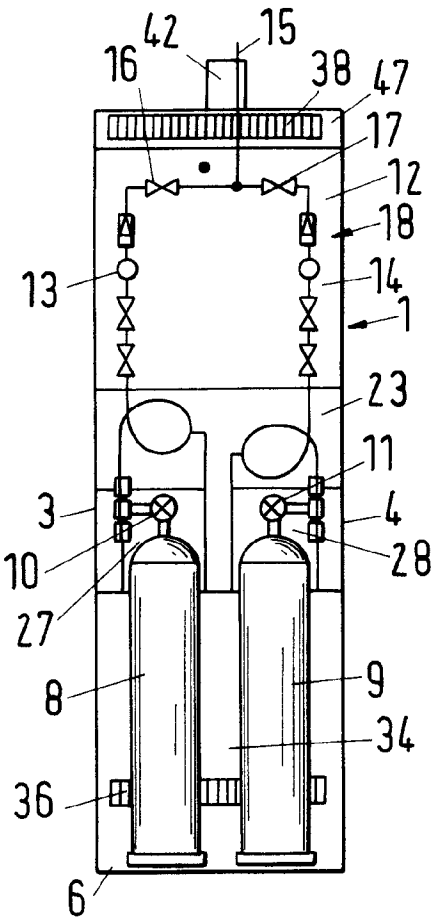
FIG. 2 a view of the front side of the gas cabinet of FIG. 1 according to the invention, FIG. 3 a section along the line III-III of FIG. 1 and FIG. 5.

The gas cabinet has a housing 1 with a back wall 2, sidewalls 3, 4, a front wall 5, a bottom 6, and a ceiling 7. In the housing 1, two gas bottles 8 and 9 are provided that stand on the bottom 6 and are secured in the housing 1 in a way known in the art. The two gas bottles 8, 9 are positioned at a minimal spacing relative to one another and contain gas that is supplied in a known manner to a consumer (not illustrated). Different substances are conceivable as a gas, for example, $NH_3$ or $BCl_3$. The gas bottles 8, 9 each have a gas valve 10, 11 with which they are connected to a gas conduit system 12. The gas conduit system 12 has two conduit branches 13, 14 that are connected to a common exit line 15. The two conduit branches 13, 14 can be closed off, for example, by a valve 16, 17, respectively, relative to the exit line 15. During operation of the gas cabinet, advantageously only one of the two gas bottles 8, 9 is in use. The conduit branches 13 or 14 of the other gas bottle is closed off, for example, by the valve 16, 17 relative to the exit line 15.

In deviation from the illustrated preferred embodiment, the gas cabinet can also have only one gas bottle or more than two gas bottles.

Figure 1:
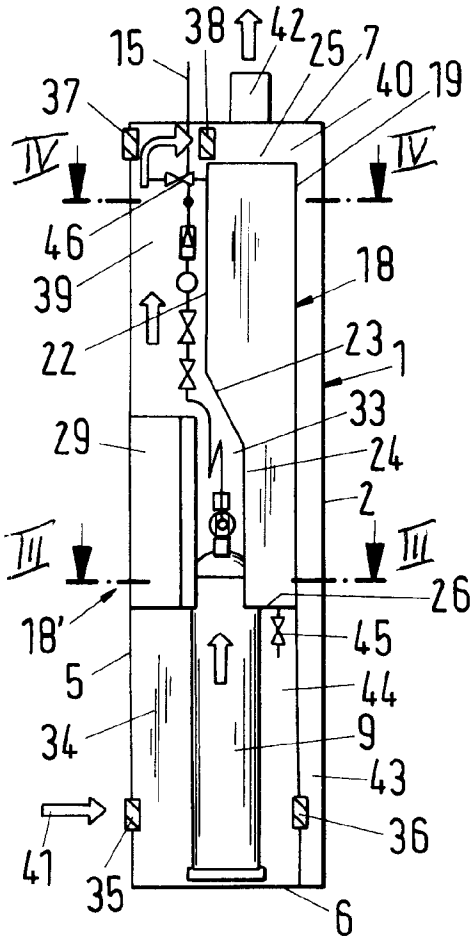
FIG. 1 in a schematic illustration and in a side view a first embodiment of the gas cabinet according to the invention.
Figure 4:
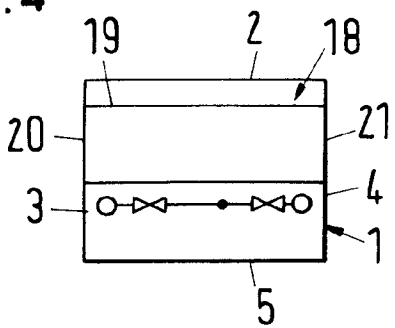
FIG. 4 a section along the line IV-IV of FIG. 1 and FIG. 5.

In the area between the gas conduit system 12 and the back wall 2 of the housing a gas-tight displacement body 18 is provided that is embodied as a hollow body. As shown in FIGS. 1 and 2, the displacement body 18 extends from the area of the gas bottles 8, 9 to a place near the housing ceiling 7. The displacement body 18 has a length extending between the oppositely positioned housing sidewalls 3, 4. In the area above the gas bottles 8, 9, the displacement body 18 has a rectangular cross-section (FIG. 4). The back wall 19 of the displacement body 18 is plane and extends at a minimal spacing parallel to the back wall 2 of the housing. Sidewalls 20, 21 adjoin the back wall 19 of the displacement body and extend at a right angle to the back wall and parallel to one another. The sidewalls 20, 21 are positioned advantageously so as to meet the inner side of the housing sidewalls 3, 4 and are plane. In the area above the gas bottles 8, 9 the displacement body 18 has a greater width than in the adjoining lower area (FIG. 1). Approximately at half the height, the front wall 22 positioned parallel to the back wall 19 passes by means of a wall surface 23 positioned at a slant to the rear in the direction of the back wall 19 into the lower plane wall surface 24 (FIG. 1). In the area of this wall surface 24 the displacement body 18 is, for example, only half as thick as in the upper area of the front wall 22. The displacement body 18 is closed at the top by a plane top 25 and at the bottom by a plane bottom 26.

Since the wall surface 24 extends between the gas bottles 8, 9 and the back wall 2 of the housing, the displacement body 18 at the level of the gas bottles 8, 9 is provided with a recess 27, 28 (FIG. 3), respectively, that extends from the bottom 26 of the displacement body 18 upwardly within the wall surface 24. The recesses 27, 28 have a sufficient width and depth so that the gas bottles 8, 9 can be arranged without problems in the housing 1. The gas bottles 8, 9 project with their upper end into the recesses 27, 28 of the displacement body 18. The recesses 27, 28 can extend up to the slanted surface 23. The recesses 27, 28 have in the illustrated embodiment a rectangular cross-section. They can also a have a non-angular cross-section, for example, a semicircular one, adapted to the outer shape of the gas bottle.

Figure 3:
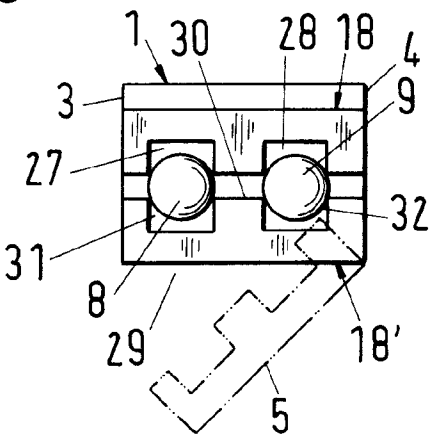

The front wall 5 of the housing 1 can have a further gas-tight displacement body 18' that at its exterior side is provided with an operating panel 29 having, for example, a touch-sensitive screen. Moreover, the operating panel 29 is provided at its rear with electronics for the gas cabinet. The front wall 5 of the housing is provided in the area of the operating panel 29 with an opening. It is also possible to arrange the operating panel 29 in the front wall 5 of the housing 1. As shown in FIG. 3, the displacement body 18' is provided at the inner side 30 facing the gas bottles 8, 9 also with two recesses 31, 32 into which the upper areas of the gas bottles 8, 9 project. Advantageously, the recesses 31, 32 are of the same size as the oppositely positioned recesses 27, 28 of the displacement body 18. The front wall 5 of the housing 1, at least in its lower area, can be pivoted from a closed position into an open position so that the gas bottles 8, 9 can be exchanged easily. The displacement body 18' is attached to the pivotable part of the front wall 5 so that it can be pivoted away together with this front wall part. In principle, it is possible that the entire front wall 5 can be opened. In FIG. 3 the open position of the front wall 5 is illustrated.

The rear area of the front wall 5 can be somewhat less wide in order to ensure that opening is possible even for housings that are positioned tightly adjacent to one another (opening radius).

The displacement body 18' that is attached to the inner side of the front wall 5 is positioned at a spacing opposite the lower part of the displacement body 18. The displacement body 18' extends approximately from the level of the bottom 26 to approximately half the height of the slanted surface 23 of the displacement body 18. Between the displacement body 18' and the oppositely positioned area of the displacement body 18 a flow chamber 33 is formed that is delimited transversely to the flow direction by the wall surfaces 23, 24 of the displacement body 18 and the inner side 30 of the displacement body 18'. Laterally, the flow chamber 33 is delimited by the housing sidewalls 3, 4. In the area of the slanted wall surface 23 of the displacement body 18 the flow cross-section is reduced, for example, continuously. In the area above the displacement body 18', the flow cross-section of the flow chamber 39 increases again and, in this area, is delimited by the front wall 22 of the displacement body 18, the front wall 5 of the housing and a part of the housing sidewalls 3, 4.

The flow chamber 33 adjoins in the downward direction a flow chamber 34 that downwardly is delimited by the housing bottom 6 and, circumferentially, by a part of the housing sidewalls 3, 4, the back wall 2, and the front wall 5. Near the bottom end of the flow chamber 34, a closable intake opening 35, 36 is provided, respectively, in the front wall 5 and in an intermediate wall 44 of the housing 1. They are formed advantageously by slides which can be moved into an open position and into a closed position. Further intake openings 37, 38 are located at the upper end of the flow chamber 39 that is in communication via flow chamber 33 with the lower flow chamber 34. The two intake openings 37, 38 are also advantageously formed by slides that are moveable from a closed position into an open position. The intake opening 37 is located in the front wall 5 of the housing. The intake opening 38 positioned at a spacing there behind separates the flow chamber 39 from the flow chamber 40 that is located between the top 25 of the displacement body 18 and the housing ceiling 7. The intake opening 38 is provided in a partition 47 which extends at the level of the front wall 22 of the displacement body 18 from its top 25 to the housing ceiling 7 and extends between the housing sidewalls 3, 4.

By means of the two displacement bodies 18, 18' the open flow cross-section of the scavenging air passage for the scavenging air within the housing 1 is reduced. The open flow cross-section is only so large that with the scavenging air 41 gases possibly exiting from the gas bottles 8, 9 and/or the conduit system 12 are reliably removed by suction. The critical area of the gas bottles 8, 9, i.e., the area about the gas bottle valves 10, 11, is positioned within the flow chamber 33 whose cross-section is selected to be optimally small. As indicated by the flow arrows in FIG. 1, the intake opening 35 at the bottom area of the flow chamber 34 is open so that through it the scavenging air 41 can reach the flow chamber 34. Here, the scavenging air flows upwardly and reaches the flow chamber 33 that is optimized such that only the amount of gas required for scavenging is required. The scavenging air 41 flows out of the flow chamber 34 through the flow chamber 33 into the flow chamber 39. The intake opening 37 is closed while the intake opening 38 is open. The scavenging air 41 flows through the intake opening 38 to an exit 42 provided in the housing ceiling 7 to which is connected a fan (not illustrated). In the described way, the scavenging air 41 flows in the gas cabinet from the bottom to the top.

Figure 5:
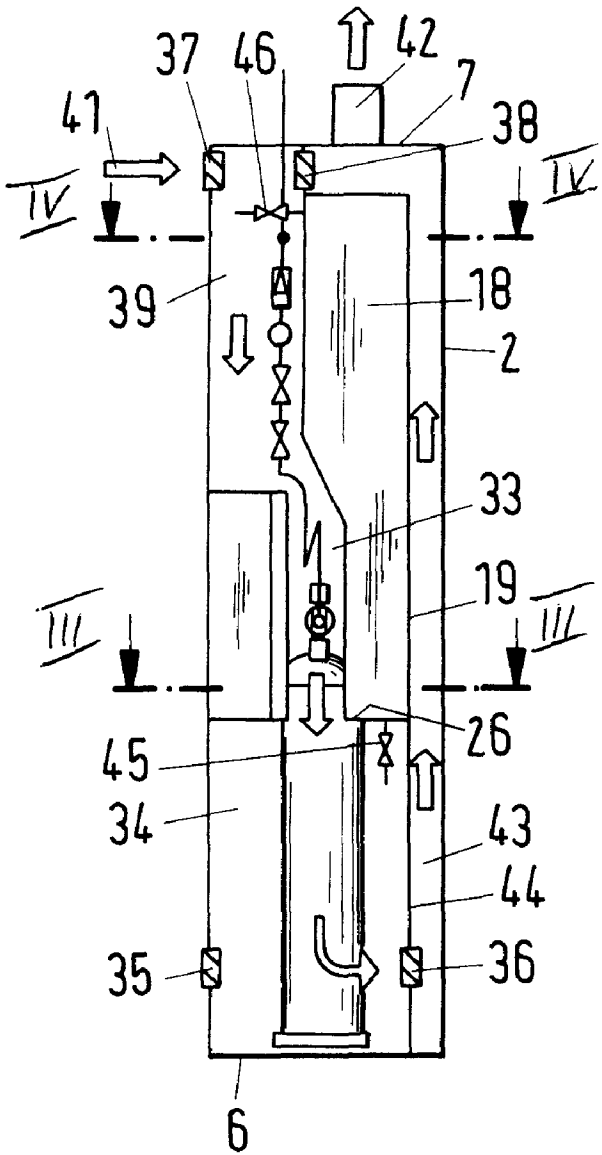
FIG. 5 the gas cabinet according to FIG. 1 showing a different air guiding action.
Figure 7:
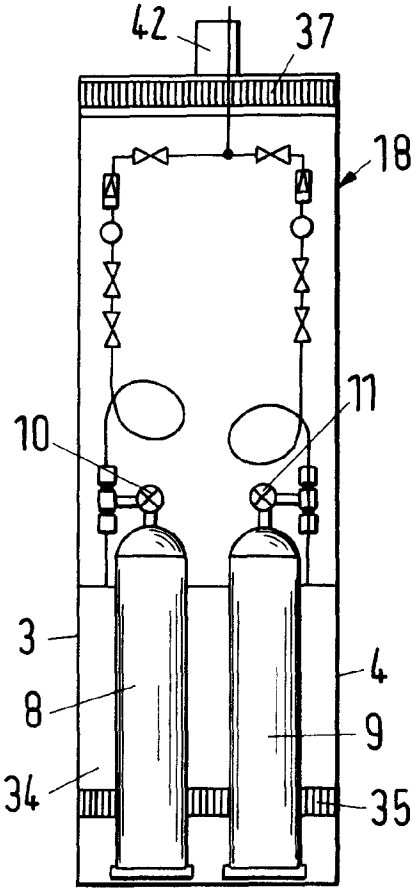
FIG. 7 a view of the front side of the gas cabinet of FIG. 6.

FIG. 5 shows that the scavenging air can also flow in a different way through the gas cabinet. In this case, the intake opening 37 is open and the intake opening 38 is closed. In the lower flow chamber 34 the intake opening 35 is dosed and the intake opening 36 is open. The scavenging air flows through the upper intake opening 37 and reaches the flow chamber 39 in which it flows downwardly. The scavenging air 41 reaches the flow chamber 33 and from there the lower flow chamber 34. Since intake opening 36 is open, the scavenging air 41 flows into a narrow flow chamber 43 that extends from the bottom 6 of the housing to the ceiling 7. It is delimited by the back wall 2 of the housing, a part of the housing sidewalls 3, 4, the displacement body 18, as well as the partition 44 in which the intake opening 36 is located. The partition 44 is positioned parallel to the back wall 2 of the housing and is aligned with the back wall 19 of the displacement body 18. The partition 44 extends from the bottom 26 of the displacement body 18 to the housing bottom 6. In the narrow flow chamber 43 the scavenging air 41 flows upwardly and reaches the flow chamber 40 positioned transversely to it. From here the scavenging air 41 escapes through the exit 42. In this flow guiding action, the potential leakage locations in the gas cabinet are also completely scavenged by the scavenging air 41 so that a risk of gases released by leakage is reliably prevented.

The displacement body 18 can be flushed or filled with an inert gas, for example, nitrogen, so that it is prevented that combustible gases contained in the displacement body 18 will ignite or dangerous gases will collect. In an exemplary fashion, in the bottom 26 and at the front wall 22 of the displacement body 18 a scavenging valve 45, 46 (FIG. 1) is provided, respectively. In this way it is possible to pass inert gas through the displacement body 18 when, simultaneously or alternatingly, the scavenging valves 45, 46 are open. For guiding the scavenging air in accordance with FIG. 1, the inert gas is supplied by means of the scavenging valve 45. Through the open scavenging valve 46 provided near the top 25 of the displacement body 18, the inert gas reaches the scavenging air flow flowing upwardly and mixes therewith and is guided to the exterior together with the scavenging air flow through the exit 42. When the scavenging air 41 is guided from top to bottom (FIG. 5), the inert gas is supplied through the upper open scavenging valve 46, exits through the lower open scavenging valve 45 from the displacement body 18, and mixes with the scavenging air 41 flowing within the flow chamber 34.

The displacement body 18' can also be provided with two scavenging valves so that it can be flushed with inert gas.

Above the housing bottom 6 a height-adjustable bottle support surface can be mounted additionally.

Figure 6:
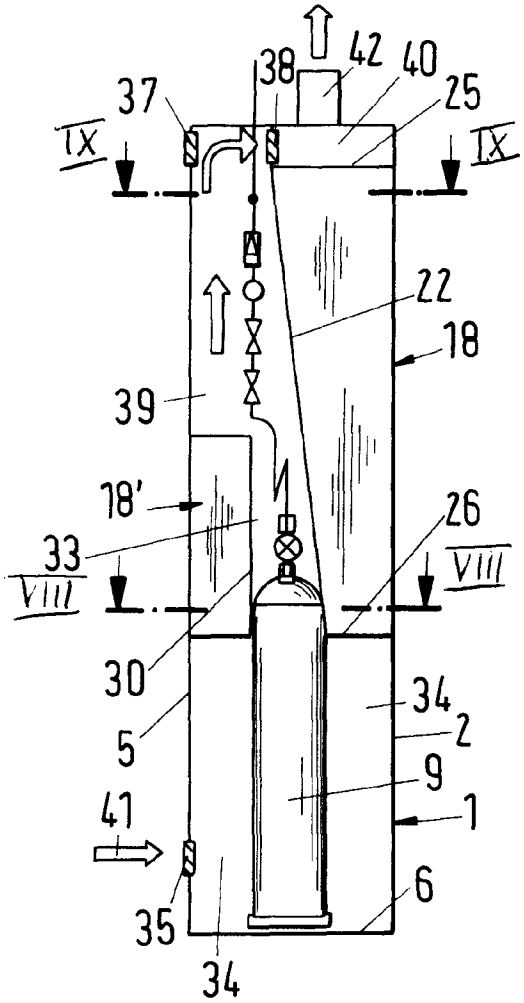
FIG. 6 a second embodiment of the gas cabinet in a schematic side view.
Figure 9:
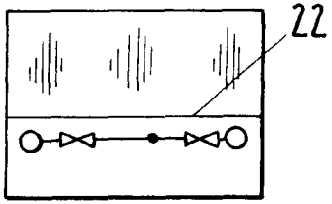
FIG. 9 a section along line IX-IX of FIG. 6.
Figure 8:
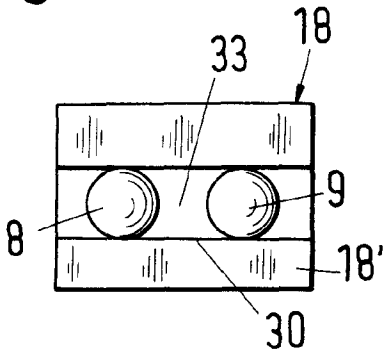
FIG. 8 a section along section line VIII-VIII of FIG. 6

In the embodiment according to FIG. 6 through 9, the displacement body 18 is part of the back wall 2 of the housing 1. Advantageously, the displacement body 18 is formed by an appropriate shaping of the housing back wall 2. The displacement body 18 for this reason is open at the back. In contrast to the preceding embodiment, the front wall 22 of the displacement body 18 extends from its bottom 26 at a slant upwardly to the top 25 of the displacement body 18. As shown in FIG. 6, the front wall 22 is plane and slanted toward the front wall 5 of the housing 1. The displacement body 18 extends again between the sidewalls 3, 4 of the housing 1. As a result of the plane front wall 22 the displacement body 18 is of a simple configuration. Because it is provided at the back wall 2 of the housing, on the front wall 22 of the displacement body 18 no recesses for the gas bottles 8, 9 are necessary as is the case in the preceding embodiment. Accordingly, in this embodiment, the partition 44 between the bottom 26 of the displacement body and the bottom 6 of the housing 1 can be eliminated. Accordingly, in the embodiment of FIGS. 6 through 9 the intake opening 36 is no longer necessary.

In case that in accordance with FIG. 5 gases present in the lower area of the gas cabinet are to be removed, the intake opening 36 is employed. It is connected to a passage (not illustrated) which opens into the flow chamber 40.

The displacement body 18' has a plane back wall 30 that extends parallel to its front side. In other respects, the displacement body 18' is identical to that of the preceding embodiment. Advantageously, the displacement body 18' is formed by an appropriate shaping of the housing front wall 5. For this reason, the displacement body 18' is open at the front.

The scavenging air 41 passes through the lower intake opening 36 in the housing front wall 5 into the lower flow chamber 34 and flows into the flow chamber 33 between the two displacement bodies 18, 18'. In contrast to the preceding embodiment, the flow cross-section of the chamber 33 decreases continuously in the flow direction. The scavenging air 41 reaches subsequently the upper flow chamber 39 located above the displacement body 18' and in front of the displacement body 18. The intake opening 37 is closed in accordance with the preceding embodiment and the intake opening 38 is open. The scavenging air 41 reaches thus the flow chamber 40 above the top 25 of the displacement body 18 and exits through the exit 42.

The embodiment according to FIGS. 6 through 9 corresponds in other respects to the preceding embodiment.

The displacement body 18 is provided at the back wall 2 of the housing and can be attached to it as a separate body. Advantageously, it is however also possible to configure the displacement body 18 and the back wall 2 of the housing as a unitary part.

In the described embodiments, the valves 10, 11 of the gas bottles 8, 9 are located in the flow chamber 33. Since the gas valves 10, 11 are the first possible leakage area, leaked gas is reliably entrained by the scavenging air 41 and removed in the described way through the exit 42.

What is claimed is:

1. A gas cabinet comprising:

a housing adapted to receive at least one gas bottle and having at least one intake opening and at least one exit opening;

a conduit system arranged in the housing to which the at least one gas bottle is to be connected;

a scavenging air passage for a scavenging air flow entering the housing through the at least one intake opening and exiting from the housing through the at least one exit opening;

wherein the gas cabinet is designed such that an open flow cross-section of the scavenging air passage in the housing is limited to an amount necessary for a scavenging action;

at least one displacement body arranged in the housing for limiting the flow cross-section in the housing.

2. The gas cabinet according to claim 1, wherein the at least one displacement body is a hollow body.

3. The gas cabinet according to claim 1, wherein the at least one displacement body has at least one connector for an inert gas for flushing the at least one displacement body.

4. The gas cabinet according to claim 1, wherein the at least one displacement body has a height and a varying cross-section across the height.

5. The gas cabinet according to claim 1, wherein the at least one displacement body extends into an area where the at least one gas bottle is located in the housing.

6. The gas cabinet according to claim 1, wherein the at least one displacement body has a side facing the at least one gas bottle and wherein said side is provided with at least one recess into which the at least one gas bottle projects.

7. The gas cabinet according to claim 1, wherein in the housing two of the at least one displacement body are provided and wherein said two displacement bodies are positioned opposite one another and spaced at a spacing from one another.

8. The gas cabinet according to claim 7, wherein said two displacement bodies project into the area where the at least one gas bottle is located in the housing.

9. The gas cabinet according to claim 7, wherein said two displacement bodies each have a side facing the at least one gas bottle and wherein said sides each have at least one recess into which the at least one gas bottle projects.

10. The gas cabinet according to claim 9, wherein the recesses in said two displacement bodies have the same size.

11. The gas cabinet according to claim 7, wherein a first one of said two displacement bodies in a flow direction of the scavenging air is longer than a second one of said two displacement bodies.

12. The gas cabinet according to claim 11, wherein a portion of said first displacement body which portion is positioned opposite said second displacement body has a smaller cross-sectional surface area than a remaining portion of said first displacement body.

13. The gas cabinet according to claim 1, wherein the at least one displacement body delimits partially a flow chamber of the scavenging air passage for the scavenging air.

14. The gas cabinet according to claim 1, wherein the at least one displacement body partially separates two flow chambers of the scavenging air passage for the scavenging air from one another.

15. The gas cabinet according to claim 14, wherein between the two flow chambers closable intake openings are provided for separating the two flow chambers from one another.

16. The gas cabinet according to claim 1, wherein in the housing two of the at least one displacement body are provided and wherein a flow chamber of the scavenging air passage for the scavenging air is provided on a side of a first one of said two displacement bodies facing away from a second one of said two displacement bodies.

17. The gas cabinet according to claim 16, wherein the flow chamber is delimited by a back wall of the housing.

18. The gas cabinet according to claim 16, wherein between said displacement body and a bottom of the housing a partition is provided that delimits the flow chamber in the area below said first displacement body, wherein the partition has at least one closable intake opening.

19. The gas cabinet according to claim 1, wherein a flow chamber of the scavenging air passage in the housing through which flow chamber the scavenging air flow passes has a continuously decreasing cross-section between two of the at least one displacement bodies in the flow direction of the scavenging air.

20. The gas cabinet according to claim 1, wherein in the housing two of the at least one displacement body are provided, wherein a front side of a first one of said two displacement bodies facing a second one of said displacement bodies is plane and extends at a slant.

21. The gas cabinet according to claim 20, wherein said second displacement body has a plane front wall.

22. The gas cabinet according to claim 1, wherein the at least one displacement body is provided on a back wall of the housing.

23. The gas cabinet according to claim 1, wherein the at least one displacement body is part of a back wall of the housing.

24. A gas cabinet comprising:

a housing adapted to receive at least one gas bottle and having at least one intake opening and at least one exit opening;

a conduit system arranged in the housing to which the at least one gas bottle is to be connected;

a scavenging air passage for a scavenging air flow entering the housing through the at least one intake opening and exiting from the housing through the at least one exit opening;

wherein the gas cabinet is designed such that an open flow cross-section of the scavenging air passage in the housing is limited to an amount necessary for a scavenging action;

wherein, for limiting the flow cross-section, the housing has an area with an appropriately reduced cross-section.

* * * * *